US006119559A

United States Patent [19]

Zerver

[11] Patent Number: 6,119,559

[45] Date of Patent: Sep. 19, 2000

[54] SOCKET WRENCH EXTENSION

[75] Inventor: Hermann J. Zerver, Remscheid, Germany

[73] Assignee: Hazet-Werk Hermann Zerver GmbH & Co. KG, Germany

[21] Appl. No.: 09/169,671

[22] Filed: Oct. 9, 1998

[30] Foreign Application Priority Data

Oct. 10, 1997 [DE] Germany ..... 197 44 865

[51] Int. Cl.[7] ..... B25B 23/16

[52] U.S. Cl. ..... 81/177.75; 81/177.85

[58] Field of Search ..... 403/322, 325, 403/74, 578, 20; 21/177.85, 177.7, 177.75, 177.8, 177.9

[56] References Cited

U.S. PATENT DOCUMENTS

| | | | |
|---|---|---|---|
| 2,987,334 | 6/1961 | Wendling . | |
| 4,733,584 | 3/1988 | Karge . | |
| 5,289,745 | 3/1994 | Beardsley . | |
| 5,291,809 | 3/1994 | Fox, III et al. . | |
| 5,433,548 | 7/1995 | Roberts et al. | 81/177.85 X |

FOREIGN PATENT DOCUMENTS

| | | |
|---|---|---|
| 0 755 757 | 1/1997 | European Pat. Off. . |
| 1170336 | 5/1957 | Germany . |
| 2118858 | 11/1972 | Germany . |
| 89096452 | 1/1994 | Germany . |
| 95/08720 | 3/1995 | WIPO . |

*Primary Examiner*—D. S. Meislin
*Attorney, Agent, or Firm*—Robert W. Becker & Associates

[57] ABSTRACT

A socket wrench extension has an insertion member having a polygonal socket head with a lateral socket head surface. A receiving member with a polygonal receiving socket is provided. A joint connects the insertion member to the receiving member. A locking element is moveably connected within the insertion member such that the locking element partially projects from the lateral socket head surface. A pressure transmission member is axially movable in the insertion member. The pressure transmission member has a first end with a key head and a second end. The key head serves as an actuating member for the pressure transmission member. The second end transforms axial movement of the pressure transmission member into an outward movement of the locking element.

4 Claims, 1 Drawing Sheet

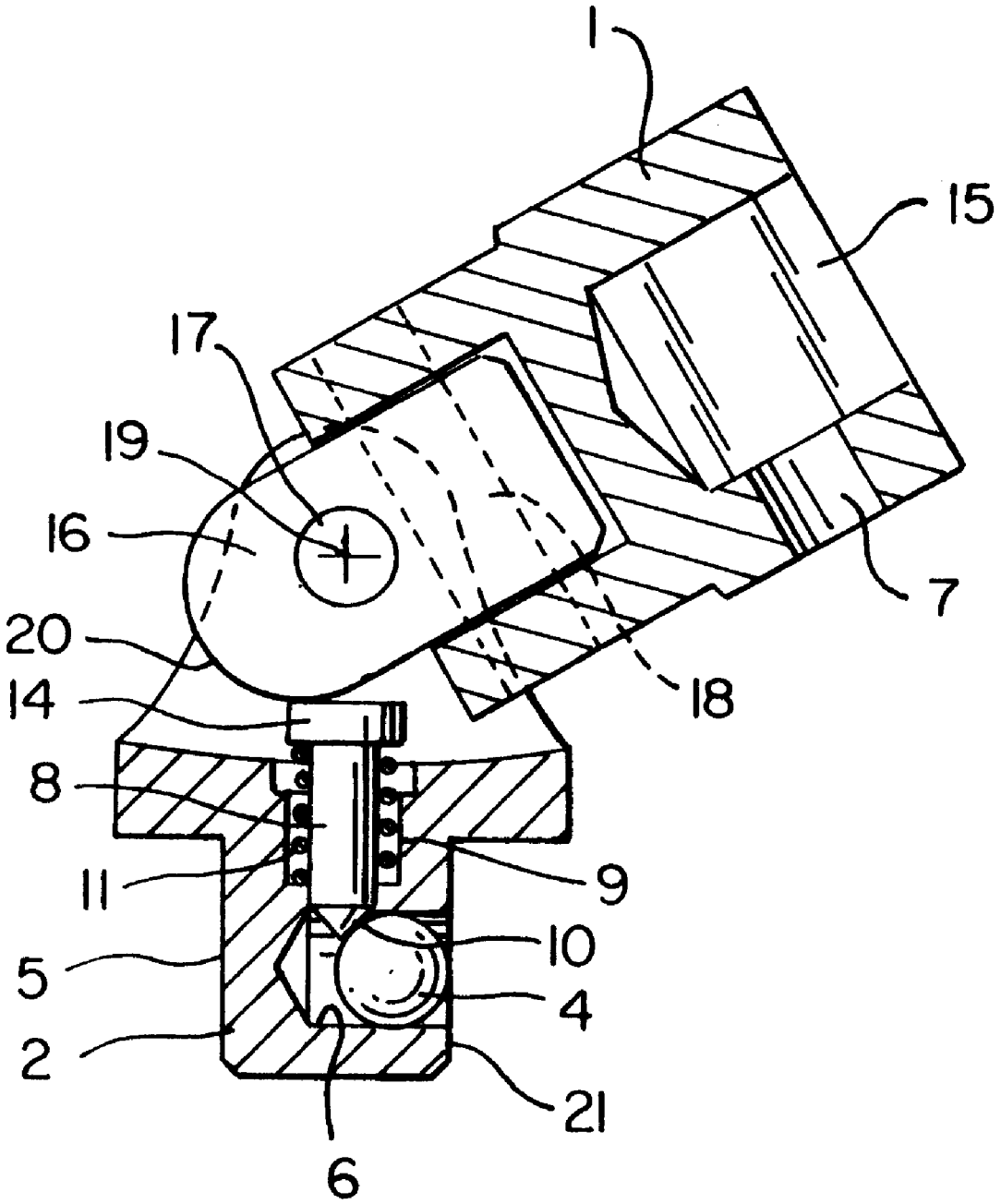
1
15
17
19
16
7
20
18
14
8
9
11
10
5
4
2
21
6

SOCKET WRENCH EXTENSION

BACKGROUND OF THE INVENTION

The present invention relates to a socket wrench extension with a polygonal insertion member at one end and a matching receiving member at the other end. A joint connects insertion member and receiving member. The insertion member is provided with a locking element that protrudes partially from a lateral socket head surface of the insertion member.

Such locking elements are designed to snap into a matching recess of a receiving member under a spring force when the insertion member of the socket wrench extension is inserted into such a receiving member, in general, the receiving portion of a socket wrench insert. The snap-in function of the locking element at the recess is designed to prevent easy separation of the two tool parts so that they can only be inserted into and detached from on another when a certain axial force is applied. However, an accidental detachment can occur, for example, when the socket wrench extension with the socket wrench insert locked thereat is to be removed from a screw or nut in a slightly slanted alignment. This may result in frictional forces between the socket wrench insert and the screw or nut which is greater than the locking forces of the spring-loaded locking element.

It is therefore an object of the present invention to provide a socket wrench extension with improved securing action of the socket wrench insert attached thereto.

SUMMARY OF THE INVENTION

The inventive design of the aforementioned socket wrench extension is characterized in that a pressure transmission member is axially positioned in the insertion member, wherein one end has a pin-shaped or key head-shaped embodiment for pressure actuation of the pressure transmission member and the other or second end is a component of a mechanism for transmitting the axial movement of the pressure transmission element, acting in the axial direction of the insertion member, into an outward movement of the locking element.

The inventive socket wrench extension is provided with a joint between the insertion member and the receiving member, especially a universal joint. In a socket wrench extension having such a joint, the extension effect is only secondary. The primary function of such an extension is the capability of using the socket wrench at an angle for working at locations which cannot be reached when the socket wrench extends linearly in the longitudinal direction. Accordingly, a universal joint embodiment in the context of this invention is also to be considered as a socket wrench extension.

The inventive socket wrench extension with universal joint provides an improved securing action of the socket wrench insert attached to the socket wrench the extension. A transmission member is guided in the insertion member of the socket wrench extension. It has a first end that is functioning as a pressure actuating element and has a second end that is a component of a mechanism with which the movement of the pressure transmitting member is transformed into an outward movement of the locking element. In one embodiment of the present invention, it is suggested, for realizing this transformation of movement, that the second end of the pressure transmitting member is provided with a slant that rests at a radially guided locking element.

For providing a return force, according to another embodiment of the invention, a spring is suggested which exerts a pressure force in the direction of the key head (first end) of the pressure transmitting member. Preferably, the spring rests with one end at the insertion member and with the other end at the pressure transmission member.

According to a preferred embodiment of the invention, the socket wrench extension is provided with a universal joint between the receiving member and the insertion member. The universal joint allows positioning of the receiving member and the insertion member at any desired angle between 0° and 90°. This embodiment is designed such that the joint element that is pivotably supported at the insertion member has preferably a pressure transmitting surface that is of an eccentric design relative to the axis of rotation of the joint. The key head at the first end of the pressure transmission member rests at this transmission surface, and the greatest radial width of the eccentric is aligned with the pressure transmission member when the receiving member and insertion member are aligned axially with one another.

BRIEF DESCRIPTION THE DRAWINGS

The object and advantages of the present invention will appear more clearly from the following specification in conjunction with the accompanying only drawing in which a side view of the socket wrench extension with a universal joint is shown.

DESCRIPTION OF PREFERRED EMBODIMENTS

The present invention will now be described in detail with the aid of a specific embodiment shown in the only drawing.

The U joint (universal joint) extension that can be used in connection with a socket wrench system comprises a receiving member 1 with its square receiving socket, the insertion member 2 with the external polygonal (square) socket head, and the joint element 16 which pivotably connects the receiving member 1 and the insertion member 2 to provide the universally movable connection. The square socket head or socket surfaces of the receiving member 1 and of the insertion member 2 correspond to the standardized international dimensions for socket wrench systems.

In a manner known to a person skilled in the art, the insertion member 2 has a locking element 4 designed as a ball. When the square socket head 5 is inserted into a square socket, as for example, provided within the receiving member 1, the locking element 4 is moved radially inwardly into the radial bore 6 and subsequently snaps into a recess provided at the square socket head. Such a recess is embodied in the receiving member 1 by a matching bore 7.

In known systems, the ball-shaped locking element 4 is forced into the radial bore 6 radially inwardly against the force of a spring. Thus, the force with which the square socket head 5 is secured in a matching square socket is determined by this spring force.

In the present invention, however, the ball-shaped locking element 4 is not loaded directly by a spring but by a pressure transmitting member 8 in the form of a short rod or pin. The pressure transmission member 8 is positioned in a longitudinal bore 9 of the insertion member 2 and has a slant 10 at the second end which rests at the ball shaped locking element 4. The other (first) end 14 is key-shaped (key head) and its backside serves as an abutment surface for the spring 11 acting thereon. The spring 11 is arranged such that it forces the pressure transmitting member 8 away from the insertion member 2 in the direction toward the universal joint element 16. Since the slant 10 in connection with locking element 4 provides a mechanism for transforming the axial movement of the pressure transmitting element 8 into a substantially radial movement of the locking element 4, the spring 11 in its unstressed state allows the ball-shaped locking element 4 to return radially inwardly into the radial bore 6. Of course, measures are provided in order to prevent the moveable ball from falling out of the insertion element 2 in this state.

The universal joint element 16 which is connected by a first bolt 17 to the insertion member 2 and by a second bolt 18 to the receiving member 1, is provided with a pressure transmitting surface 20 that is eccentric relative to the axis of rotation 19 of the bolt 17. The pressure transmission surface 20 rests on the key head 14 of the pressure transmitting member 8, whereby, as can be seen in the drawing, the eccentrically designed pressure transmitting surface 20 has the greatest distance from the axis of rotation 19 at the location where the key head 14 contacts it when receiving member 1 and the insertion portion 2 are aligned axially.

In the case of an angled position between the receiving member 1 and the insertion member 2, as shown in the drawing, the eccentric pressure transmitting surface 20 releases the pressure transmitting member 8 so that the effect of the spring 11 removes it from the locking element 4. The locking element 4 can thus be completely retracted into the radial bore 6. When the receiving member 1 is pivoted into alignment, the pressure transmitting member 8 is then pushed by the eccentric pressure transmitting surface 20 into the insertion member 2 so that the locking element 4 is pushed into a radially outward position in which it projects from the lateral socket head surface 21 so that the locking element 4 is fixed in this position. A socket wrench received on the socket head can then no longer be removed even when subject to force.

The eccentric contour of the pressure transmitting surface 20 is selected such that the release of the locking element 4 is possible only when, as shown in the drawing, the receiving member 1 and insertion member 2 are angled relative to one another.

The specification incorporates by reference the disclosure of German priority document 197 44 865.8 of Oct. 10, 1997.

The present invention is, of course, in no way restricted to the specific disclosure of the specification and drawings, but also encompasses any modifications within the scope of the appended claims.

What is claimed is:

1. A socket wrench extension comprising:

an insertion member (2) having a polygonal socket head (5);

said insertion member (2) having a lateral socket head surface (21);

a receiving member (1) having a polygonal receiving socket (15);

a joint (16, 17, 18,) connecting said insertion member (2) to said receiving member (1), wherein said joint comprises a joint element (16) having a pressure transmission surface (20), and wherein said joint element (16) is connected to said insertion member (2) and is pivotably about an axis of rotation (19) relative to said insertion member (2), wherein said pressure transmission surface (20) is eccentrically arranged relative to an axis of rotation of said joint element (16) and has an eccentric surface point at which a radial width between said pressure transmission surface (20) and said axis of rotation (19) is greatest;

a locking element (4) moveably connected within said insertion member (2) so as to have a release position and a locking position, wherein in said locking position said locking element (4) partially projects from said lateral socket head surface (21);

a pressure transmission member (8) axially moveable in said insertion member (2);

said transmission member (8) having a first end with a key head (14) and having a second end (10);

said key head (14) serving as an actuating member for said pressure transmission member (8), wherein said eccentric pressure transmission surface (20) rests against said key head (14), and wherein a greatest radial width extending between said eccentric surface point and said axis of rotation is aligned with said pressure transmission member (8) when said insertion member (2) and said receiving member (1) are axially aligned with one another;

a spring (11) mounted in said insertion member (2) and engaging said pressure transmission member (8) so as to force said pressure transmission member (8) in a direction away from said locking element (4) and allow said locking element (4) to reach said rest position;

said second end (10) configured to act on said locking element (4) such that an axial movement of said pressure transmission member (8) in a direction toward said locking element (4) pushes said locking element (4) outwardly into said locking position.

2. A socket wrench extension according to claim 1, wherein:

said second end (10) has a slant (10);

said locking element (4) is radially moveable in said insertion member (2); and said slant (10) rests on said locking element (4).

3. A socket wrench extension according to claim 1, wherein said spring (11) has a first end resting against said insertion member (2) and has a second end resting against said pressure transmission member (8).

4. A socket wrench extension according to claim 1, wherein said joint is a universal joint (1, 17, 18).

* * * * *